US007228976B2

(12) United States Patent
Pretorius

(10) Patent No.: US 7,228,976 B2
(45) Date of Patent: Jun. 12, 2007

(54) TOOTHBRUSH HOLDER

(75) Inventor: Jaco Pretorius, Somerville, MA (US)

(73) Assignee: Mide Technology Corporation, Medford, MA (US)

( * ) Notice: Subject to any disclaimer, the term of this patent is extended or adjusted under 35 U.S.C. 154(b) by 262 days.

(21) Appl. No.: 10/960,858

(22) Filed: Oct. 7, 2004

(65) Prior Publication Data

US 2006/0076302 A1 Apr. 13, 2006

(51) Int. Cl.
*A47B 81/02* (2006.01)

(52) U.S. Cl. ..... 211/65; 211/73

(58) Field of Classification Search ..... 211/65, 211/72, 73; 248/110; 220/62; 206/362, 206/362.1, 485, 362.4
See application file for complete search history.

(56) References Cited

U.S. PATENT DOCUMENTS

| | | | | |
|---|---|---|---|---|
| 2,125,784 | A * | 8/1938 | Higgins | 248/109 |
| 2,224,938 | A * | 12/1940 | Steckler | 211/70.1 |
| 3,002,630 | A * | 10/1961 | Heisser | 211/65 |
| 3,685,660 | A * | 8/1972 | Saunders | 211/70.1 |
| 4,407,417 | A * | 10/1983 | Boyle | 211/69.1 |
| D278,777 | S | 5/1985 | Martin | |
| 4,770,379 | A | 9/1988 | Estvold | |
| 4,940,199 | A * | 7/1990 | Hall | 248/37.3 |
| D309,840 | S | 8/1990 | Estvold | |
| D341,510 | S | 11/1993 | Lieberman | |
| 5,259,519 | A | 11/1993 | Lieberman | |
| 5,297,677 | A | 3/1994 | Burian et al. | |
| 5,480,027 | A | 1/1996 | Leonard | |
| 5,484,065 | A | 1/1996 | Lavoli, Jr. et al. | |
| 5,687,855 | A | 11/1997 | Heller | |
| D417,110 | S | 11/1999 | Dillon et al. | |
| 6,199,821 | B1 | 3/2001 | Job | |
| 6,311,854 | B1 | 11/2001 | Anderson | |
| 6,347,772 | B1 * | 2/2002 | L'Hotel | 248/174 |
| 6,401,943 | B1 | 6/2002 | Root | |

* cited by examiner

*Primary Examiner*—Jennifer E. Novosad
(74) *Attorney, Agent, or Firm*—Iandirio & Teska

(57) ABSTRACT

A deployable toothbrush holder includes a single piece of sheet material including spaced first and second end edges. A single fold area across the sheet material defines a holder portion and a base portion. The holder portion terminates in the first end edge and has a length relative to the base portion to impart a smooth sloping curvature to the holder portion without fold lines when the toothbrush holder is deployed. The base portion terminates at the second end edge. At least one toothbrush receiving orifice in the holder portion is sized to receive the shaft of the toothbrush. At least one toothbrush receiving orifice in the base portion is sized to receive the shaft of a toothbrush and is aligned with the orifice in the holder portion. A key extends outwardly from the second edge, and a lock for receiving the key is disposed in the holder portion. The lock is spaced from the first end edge to angle the base portion and to deploy and support the holder portion in a position spaced from the base portion with the orifice in the base portion elevated.

24 Claims, 5 Drawing Sheets

TOOTHBRUSH HOLDER

FIELD OF THE INVENTION

This invention relates to an improved toothbrush holder, and more particularly, a toothbrush holder that is easily packaged and assembled and which is also low cost and disposable.

BACKGROUND OF THE INVENTION

There are many different types of toothbrush holders. Conventional holders are typically fixtures attachable to, or mountable on, a wall. Various types of fasteners, screws, bolts, nails and/or adhesives are utilized to affix these holders to the wall. Most holders include holes or openings to accommodate the shaft of the toothbrush so the toothbrush hangs down as the bristles of the toothbrush dry. However, conventional toothbrush holders have several disadvantages. They are often permanent, and/or generally cannot be removed without damage or blemish to the wall or surface to which they are attached. Furthermore, such devices are difficult to clean. As toothpaste and residue builds up, the holders become hotbeds of germs and bacteria, and become unsightly. Also, such toothbrush holders take up wall valuable wall space, which can be limited especially in bathrooms where toothbrushes are kept.

Moreover, these types of attached toothbrush holders are not practical for travelers. The traveler cannot bring the affixed toothbrush holder from his or her home. Also, the notion of placing one's toothbrush in a hotel or motel toothbrush holder that countless strangers have used, or even into the holder in the home of a friend or family member, may be less than appealing to the traveler.

As a result, the traveler may simply leave the toothbrush laying on the sink area, or may store it in a plastic bag or container. Leaving the toothbrush on the sink exposes the toothbrush to dirt, contamination, and/or unsanitary conditions. Enclosing the wet toothbrush in a plastic bag or container prevents the toothbrush from drying satisfactorily, which can also lead to unhealthy results.

Alternatively, the traveler may devise means to care for the toothbrush, such as using available drinking glasses or cups to store and dry the toothbrush. Use of a drinking glass or cup also has disadvantages. In most hotels, motels, or inns, only a finite number of glasses or cups are provided, and use of one as a makeshift toothbrush holder translates to either one less glass that may be needed, or to washing the glass prior to using it for drinking. Also, a typical drinking glass does not provide sufficient means to keep toothbrushes separate should there be more than one toothbrush that needs to be stored, such as when the traveler is staying with companions. Plastic cups suffer from the same disadvantages. In addition, plastic cups usually fail to properly stand up to the weight of a toothbrush leaning on one side. Without proper and delicate balancing, the cup will fall over, dropping the toothbrush. This can be frustrating and exasperating for the traveler.

Those skilled in the art have previously attempted to overcome these problems. A disposable drinking cup with breakthrough tabs located on the bottom, base or side sections is disclosed in U.S. Pat. No. 5,484,065. The breakthrough tabs must be leakproof for drinking when intact, yet the user must punch through them in order to store the toothbrush, leading to relatively complex manufacturing, assembly, and required steps for usage. Also, once the holes are punched through, the cup no longer can be used for drinking, or for rinsing the mouth after brushing more than once.

A rounded stackable toothbrush holder in the shape of an upside down cup is disclosed in U.S. Pat. No. 5,480,027. While there is little to no assembly required, this design suffers from the disadvantage that it is also relatively complex to manufacture. Also, the size and shape preclude easy shipping and storage. This type of toothbrush holder could not readily be provided in a hotel accommodation kit, for example. Moreover, it would not fit easily into a traveler's travel case without taking up too much room, or without the possibility of being deformed or crushed.

The upright rounded plastic toothbrush holder disclosed in U.S. Pat. No. 5,867,855 is quite similar in shape to the toothbrush holder having the upside down cup shape as disclosed in U.S. Pat. No. 5,480,027, except that it has no sides. Instead, U.S. Pat. No. 5,867,855 discloses legs supporting the top portion. The top portion contains holes for toothbrushes. Although it does not quite have a full upside down cup shape, this holder suffers from the same disadvantages of relatively large, bulky size and complexity of manufacture in addition to not supporting the toothbrush against sliding out from underneath the holder.

U.S. Pat. No. 4,770,379 discloses a toothbrush holder formed from a single piece of material. However, it also has a number of disadvantages. It requires a relatively complex assembly along a number of fold lines such that a user may be unable to satisfactorily assemble the holder, or may give up trying after realizing that it is not a sufficiently quick and easy process. Moreover, the proper assembly of side tabs along the bottom edges must be engaged to prevent the handle of the toothbrush from moving laterally out of the confines of the toothbrush holder.

U.S. Pat. No. 5,297,677 also discloses a toothbrush holder formed from a single piece of material but it also has a number of disadvantages. In one embodiment there are multiple fold lines and panels. This results in a holder that is relatively complex and time-consuming to assemble. Also, this embodiment includes two panels parallel to the supporting surface on which it rests, such as a table, and one of those panels serves to support the weight of the toothbrushes. A second embodiment without a bottom panel also includes multiple folds and panels, and therefore is also relatively complex and time-consuming to assemble. A third embodiment includes openings which are not sized for the shaft of a toothbrush, but rather are substantially horizontal and slanted with respect to the supporting surface. In this embodiment, the bottom panel has no openings. As a result, the toothbrushes are not very stable, and must essentially be balanced in the toothbrush holder by the user. Also, because the toothbrushes are not upright, there will be less drainage, and the drainage that does occur will potentially wet more of the holder.

Moreover, modern, ergonomically designed toothbrushes have relatively large handles. Toothbrushes with these features often do not fit into traditional toothbrush holders.

SUMMARY OF THE INVENTION

It is therefore an object of this invention to provide an improved toothbrush holder.

It is a further object of this invention to provide a toothbrush holder that is freestanding, simple to assemble and use and which is disposable.

It is a further object of this invention to provide a toothbrush holder that can be manufactured at low cost and which is relatively easy to manufacture and package.

The invention results from the realization that an improved toothbrush holder which is freestanding when deployed and which is disposable can be achieved with a single piece of sheet material including a single fold defining a holder portion and a base portion, the holder portion having a length relative to the base portion to impart a smooth sloping curvature to the holder portion without fold lines when the toothbrush holder is deployed, and toothbrush receiving orifices sized to received the shaft of any manual toothbrushes in the holder portion and the base portion. The invention results from the further realization that an improved toothbrush holder can be achieved with a single piece of sheet material including a key extending outwardly from an edge of the base portion of the single piece of sheet material. A lock for receiving the key disposed in the holder portion and spaced from the edge of the holder portion to angle the base portion and to deploy and support the holder portion in a position spaced from the base portion.

The subject invention, however, in other embodiments, need not achieve all these objectives and the claims hereof should not be limited to structures or methods capable of achieving these objectives.

This invention features a deployable toothbrush holder including a single piece of sheet material having spaced first and second end edges. A single fold area across the sheet material defines a holder portion and a base portion, the holder portion terminating in the first end edge and having a length relative to the base portion to impart a smooth sloping curvature to the holder portion without fold lines when the toothbrush holder is deployed, the base portion terminating in the second end edge. At least one toothbrush receiving orifice in the holder portion is sized to receive the shaft of a toothbrush. At least one toothbrush receiving orifice in the base portion is sized to receive the shaft of a toothbrush and is aligned with the orifice in the holder portion. A key extends outwardly from the second edge, and a lock for receiving the key is disposed in the holder portion. The lock is spaced from the first end edge to angle the base portion and to deploy and support the holder portion in a position spaced from the base portion with the orifice in the base portion elevated. The base portion may be curved when deployed. The single piece of sheet material may be polyethylene, and the polyethylene may be high density polyethylene. The thickness of the single piece of sheet material may be between thirty and forty millimeters. The key may be a tab and the lock may be a slot. The slot may be oriented at an angle to the first end edge of the holder portion. The at least one toothbrush receiving orifice may be sized to receive the shaft of any size manual toothbrush, and may have an area between 0.465 square inches and 1.240 square inches, and may have an area of 0.465 square inches. The holder portion may include two toothbrush receiving orifices each sized to receive the shaft of a toothbrush at the apex of the deployed curved holder portion. The toothbrush receiving orifices may be sized to receive the shaft of any size manual toothbrush. The base portion may include two toothbrush receiving orifices sized to receive the shaft of any size manual toothbrush each aligned with a toothbrush receiving orifice in the holder portion. The single piece of sheet material may be paper. The paper may be wax-coated paper and the wax-coated paper may include a sterile coating. The single piece of sheet material may be plastic, PVC or polyethylene. The apex of the deployed curved holder portion may be spaced from the center of the base portion approximately 1.575 inches when the toothbrush holder is deployed.

This invention also features a deployable toothbrush holder including a single piece of sheet material made of polyethylene between thirty and forty mils thick having spaced first and second end edges. A single fold area across the sheet material defines a holder portion and a base portion, the holder portion terminating in the first end edge, the base portion terminating in the second end edge. Two toothbrush receiving orifices are in the holder portion, each toothbrush receiving orifice sized to receive the shaft of a toothbrush. Two toothbrush receiving orifices are in the base portion, each toothbrush receiving orifice sized to receive the shaft of a toothbrush. A key extends outwardly from the second edge, and a lock for receiving the key is disposed in the holder portion spaced from the first edge to angle the base portion.

This invention further features a deployable toothbrush holder including a single piece of sheet material having spaced first and second end edges, and a single fold area across the sheet material defining a holder portion and a base portion. The holder portion terminates in the first end edge and has a length relative to the base portion to impart a smooth sloping curvature to the holder portion without fold lines when the toothbrush holder is deployed, the base portion terminating in the second end edge. At least one toothbrush receiving orifice in the holder portion is sized to receive the shaft of a manual toothbrush. At least one toothbrush receiving orifice in the base portion is sized to receive the shaft of a toothbrush and is aligned with the orifice in the holder portion. A tab extends outwardly from the second end edge, and a slot at an angle to the first end edge for receiving the key is disposed in the holder portion. The slot is spaced from the first end edge to angle the base portion and to deploy and support the holder portion in a position spaced from the base portion.

This invention also features a toothbrush holder including a single piece of sheet material having spaced first and second end edges, a single fold area across the sheet material defining a curved holder portion and a curved base portion, the holder portion terminating in the first end edge and the base portion terminating in the second end edge. At least one toothbrush receiving orifice in the holder portion is sized to receive the shaft of a toothbrush. A key extends outwardly from the second edge, and a lock for receiving the key is disposed in the holder portion spaced from the first end edge to angle the base portion.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
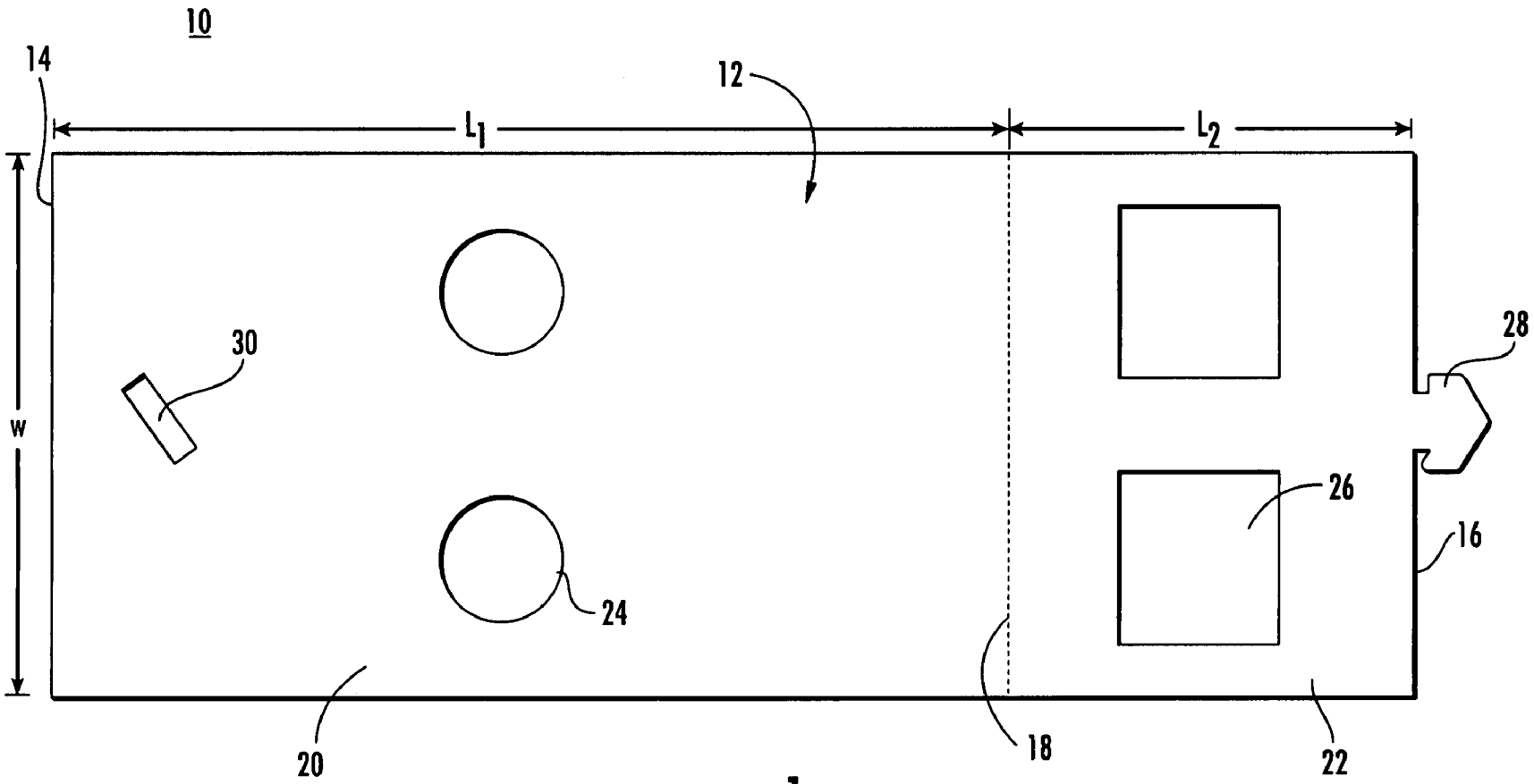
FIG. 1 is a schematic top view of a toothbrush holder in accordance with the present invention in its flat configuration.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2A:
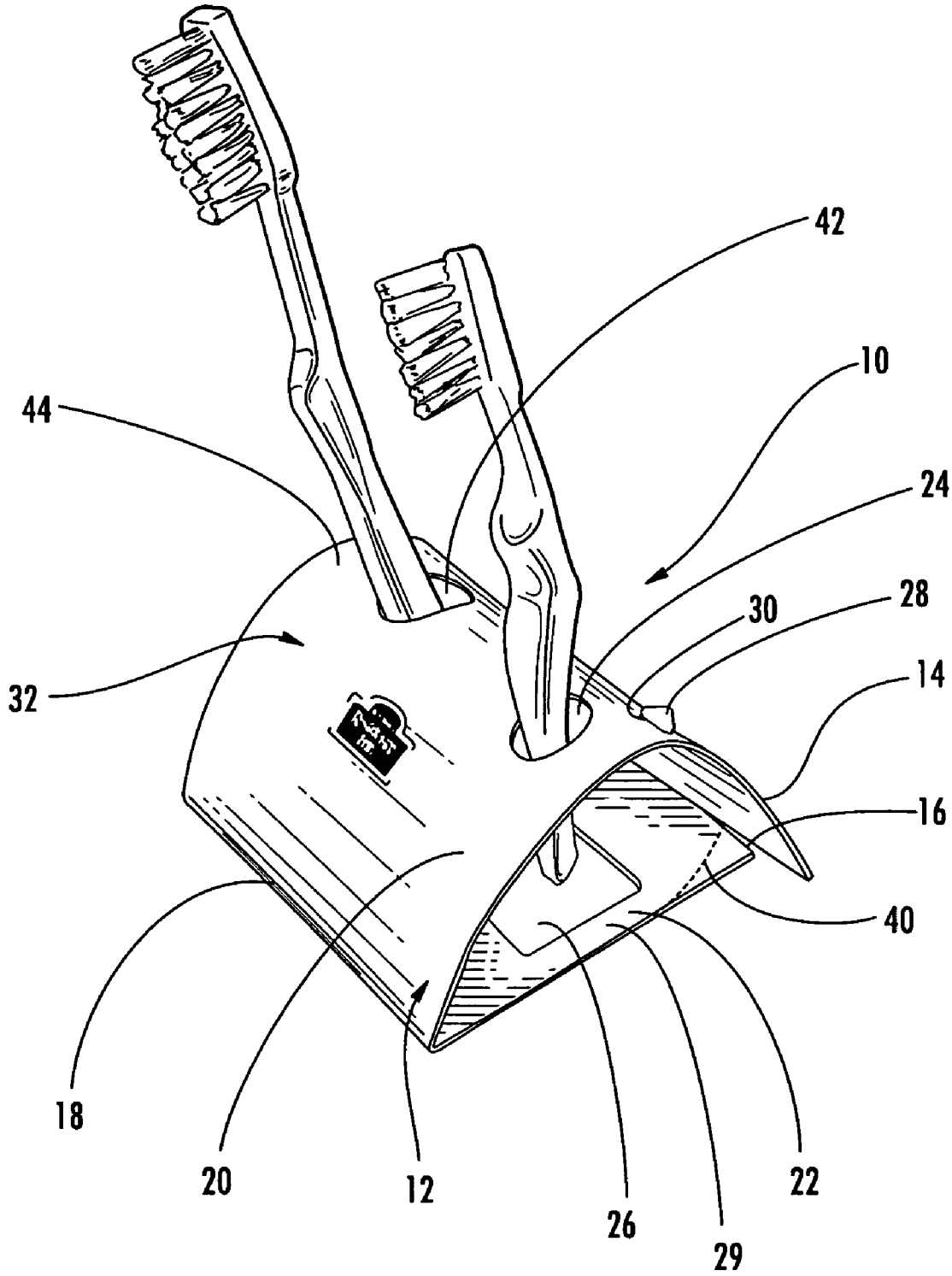
FIGS. 2A and 2B are schematic three-dimensional perspective views of the toothbrush holder of FIG. 1 in its deployed configuration.
Figure 2B:
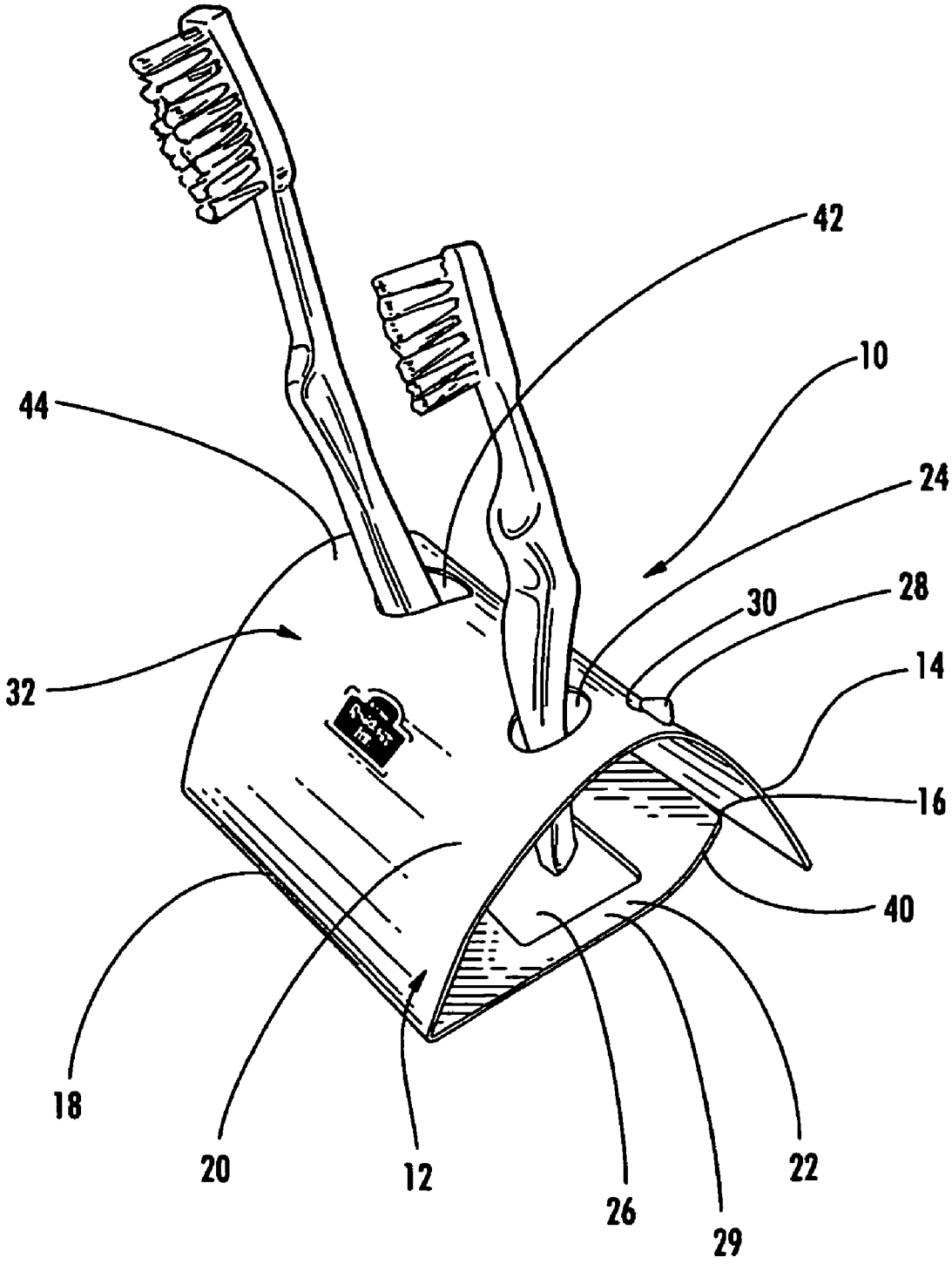

Toothbrush holder 10, FIG. 1, in accordance with the present invention is shown in its flat configuration. Toothbrush holder 10 is formed from single piece of sheet material 12 and is easily deployable to an upstanding, freestanding position as shown in FIG. 2.

Toothbrush holder 10, FIG. 1, includes single piece of sheet material 12 having spaced end edges 14 and 16. Single fold area 18 across single piece of sheet material 12 defines holder portion 20 and base portion 22. Holder portion 20 terminates in end edge 14 and includes at least one toothbrush receiving orifice or opening 24 sized to receive the shaft of any known manual, as opposed to electric for example, toothbrush, including modern, ergonomically designed toothbrushes, which typically having larger sized handles than traditional toothbrushes. Orifice 24 need not be round, but may be any desired shape. Base portion 22 terminates in end edge 16 and includes at least one toothbrush receiving orifice or opening 26, also sized to receive the shaft of a manual toothbrush and aligned with orifice 24. As shown, orifice 26 is square, although it need not be square but may be of any desirable shape. Also, in one example, the distance from end edge 14 to end edge 16 is approximately 8.660 inches, and the width W of single piece of sheet material 12 is approximately 3.310 inches.

Key 28 extends outwardly from edge 16, and lock 30 for receiving key 28 is spaced from edge 14. Lock 30 and key 28 facilitate assembly of toothbrush holder 10 as described below.

Toothbrush holder 10 may be packaged flat, as shown in FIG. 1. However, single piece of sheet material 12 is easily deployable by bending single piece of sheet material 12 at fold area 18 such that the bending moves holder portion 20 upwards. Holder portion 20 has length $L_1$ (in FIG. 1) relative to length $L_2$ (in FIG. 1) of base portion 22 to impart smooth sloping curvature 32, FIG. 2, to holder portion 20 without fold lines when toothbrush holder 10 is deployed. Lock 30 for receiving key 28 is disposed in holder portion 20, and is spaced from edge 14 to angle base portion 22 and to deploy and support holder portion 20 in a position spaced from base portion 22, with orifice 26 elevated.

Figure 4:
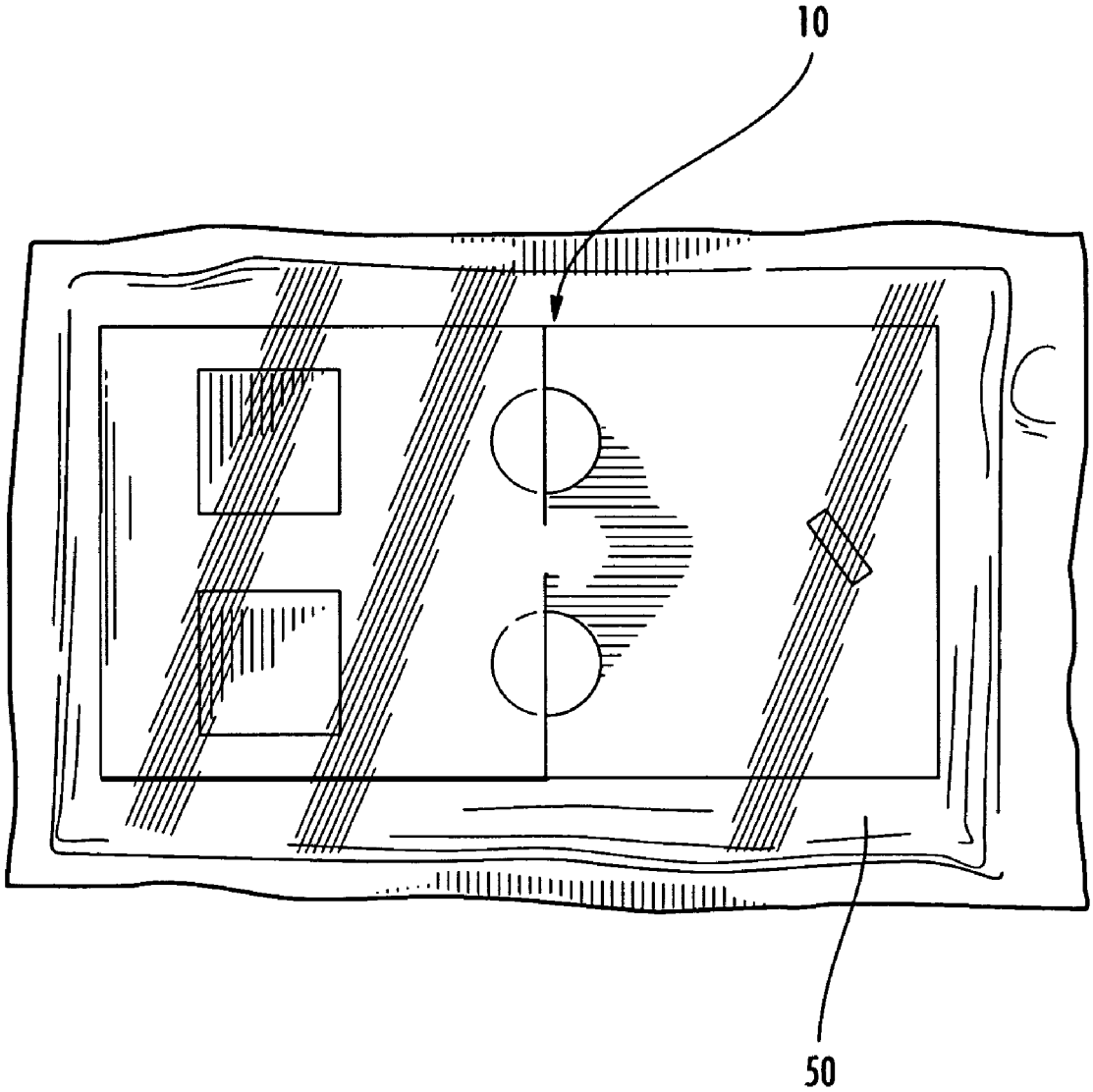
FIG. 4 is a schematic top view of one example of the toothbrush holder of FIG. 1 as packaged in plastic for shipping and/or for sale.

With toothbrush holder 10, a hotel guest or traveler is no longer required to use drinking glasses or plastic cups as makeshift toothbrush holders, or to use bulky and/or complex substitutes. Toothbrush holder 10 is packageable in a flat package as shown in FIG. 1, or preferably packaged as shown in FIG. 4, with either way of packaging providing an economical package. From either package, toothbrush holder 10 is easily deployable to a freestanding configuration and with minimal folding and the key and lock, toothbrush 10 is simple to assemble and use.

When toothbrush holder 10 is deployed, FIG. 2, base portion 22 may be curved as shown in phantom at 40, such that holder portion 20 is curved and base portion 22 is curved.

Also when toothbrush holder 10 is deployed, key 28 receives lock 30. In one example, slot 30, FIG. 1 is oriented at an angle to edge 14 to better hold lock 30 in key 28. As shown, lock 30 is a slot in single piece of sheet material 12 and key 28 is a tab with a triangulate shape. The applicant has determined that lock 30 in the form of a slot, and key 28 in the form of a tab, are preferred as the best manner in which to secure the lock and key, ease the assembly process, and resist unlocking during use while still remaining easy to unlock deliberately. However, this is not a necessary limitation of the invention. Lock 30 may be a loop or other device, for example, and key 28 may be a hook or other device to match and fit into lock 30. Those skilled in the art will recognize that key 28 and lock 30 may be any suitable sizes or shapes as desired for a particular application.

Preferably, single piece of sheet material 12 is made of polyethylene to minimize any deleterious effects on toothbrush holder 10 caused by wet or damp toothbrushes. In a preferred embodiment, single sheet of material 12 is made of high-density polyethylene, which is a unique polymer which is easy to form, and which retains its shape once folded. Also, this material is relatively inexpensive but does not delaminate or break with multiple folds. Moreover, polyethylene or high-density polyethylene are sterile, which is desirable. However, this is not a necessary limitation of the invention. Single piece of sheet material 12 may be made of paper or plastic. If single piece of sheet material 12 is paper or similar material, it will typically include a waterproof or water resistant material, also to minimize the adverse affects of water or toothbrush residue. In one example, single piece of sheet material 12 may be wax coated paper or cardboard. Also, toothbrush holder 10 may be made of thin PVC, which holds its shape well and which can be made thin and sterile. Also, polypropylene PP sheets may be used, which are easily formable into shapes, widely available, and which holds its shape fairly well. With any material, typically, single piece of sheet material 12 is in the range of twenty to fifty milli inches (mils) in thickness. Preferably, the thickness of single piece of sheet material 12 is between thirty and forty mils. Accordingly, the design, shape, and materials of toothbrush 10 make it relatively low cost and easy to manufacture. Although not necessary with polyethylene, which has the property of being sterile, anti-bacterial or sterilization coatings or treatments may be applied at the manufacturing phase in order to sterilize toothbrush holder 10.

Typically, holder portion 20 of toothbrush holder 10, FIG. 2 will include two toothbrush receiving orifices or openings 24 and 42 at the apex 44 of holder portion 20 when toothbrush holder 10 is deployed and holder portion 20 is curved. Each of toothbrush receiving orifices or openings 24 and 42 are sized to receive the shaft of a toothbrush. Depending on a particular desired application or use, however, there may more than two openings (not shown) in holder portion 20 proximate apex 44. In this way, multiple toothbrushes may be accommodated.

Figure 3:
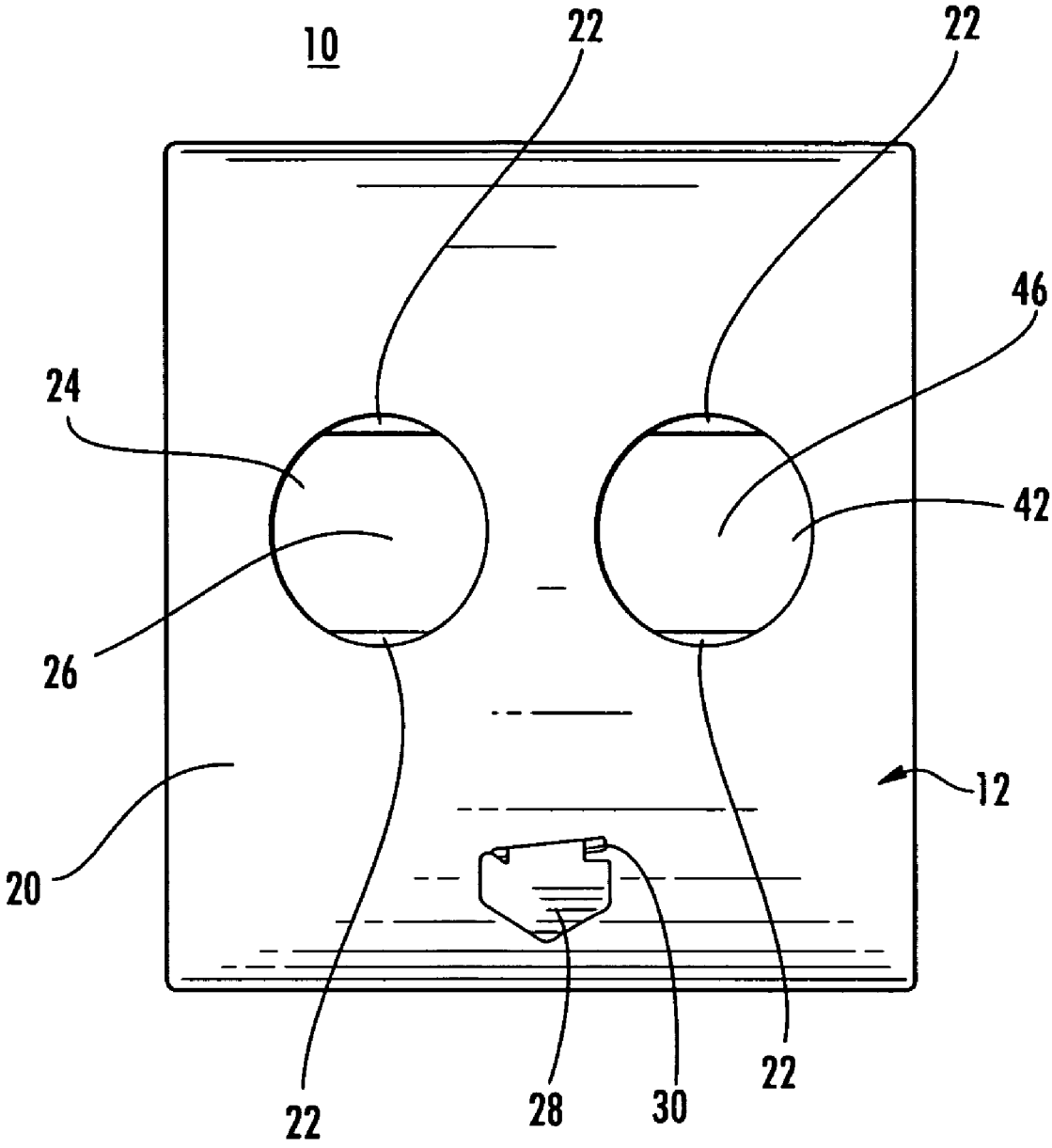
FIG. 3 is a schematic top view of the toothbrush holder of FIG. 1 in its deployed configuration.

Preferably, base portion 22 will also include two toothbrush receiving orifices or openings 26 and 46 each aligned with a toothbrush receiving orifice in holder portion 20. As shown, orifice 24 in holder portion 20 is aligned with orifice 26 in base portion 22, and orifice 42 in holder portion 20 is aligned with orifice 46, FIG. 3 in base portion 22. Thus, the toothbrushes are held stable without resort to complex folds and side tabs at the edges of the bottom portion, and without the necessity of having to place and/or balance the toothbrushes in horizontal openings. Also, with any number of toothbrush receiving orifices, when toothbrush holder 10 is deployed and holder portion 20 is curved, apex 44 of holder portion 20 is typically spaced from center 29 of base portion 22 approximately 1.575 inches.

The orifices or openings in toothbrush holder 10, such as orifices or openings 24, 42, 26 and 46, are not limited to any particular shape, but may be round, oval, square, rectangular or other suitable shapes, as long as the openings are large enough to accommodate any type of manual toothbrush as discussed. To accommodate the shaft of toothbrushes, orifices 24, 42, 26 and 46 typically will have an area in the range of approximately 0.465 square inches to 1.240 square inches, with a minimum area of approximately 0.465 square inches.

As noted above, toothbrush holder 10 may be in the flat configuration. Preferably, toothbrush holder 10 is packaged as shown in FIG. 4, where it is packaged in plastic 50 and ready for shipping, or to be placed on a shelf in a store, or ready to be deployed in a hotel room, a dentist's office, or at home.

The present invention thus provides a toothbrush holder for a variety of toothbrushes which is easily and conveniently packaged, easily deployable, and which is formed from a single piece of sheet material. It is low cost, more hygienic, easy to manufacture, easy to assemble, and well suited for use by travelers or others. It is easy to place and remove, and holds manual toothbrushes of any known size securely upright for drainage and drying, while preventing contact with unsanitary bathroom surfaces and minimizing contact between toothbrushes. The present invention provides these advantages and versatility without damaging walls or taking up wall space, and does so with the added convenience of disposability after use.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A deployable toothbrush holder comprising:

a single piece of sheet material having spaced first and second end edges;

a single fold area across the sheet material defining a holder portion and a base portion, the holder portion terminating in the first end edge and having a length relative to the base portion to impart a smooth sloping curvature to the holder portion without fold lines when the toothbrush holder is deployed, the base portion terminating in the second end edge;

at least one toothbrush receiving orifice in the holder portion sized to receive the shaft of a toothbrush;

at least one toothbrush receiving orifice in the base portion sized to receive the shaft of a toothbrush and aligned with the orifice in the holder portion;

a key extending outwardly from the second edge; and a lock for receiving the key disposed in the holder portion, said lock spaced from the first end edge to angle the base portion and to deploy and support the holder portion in a position spaced from the base portion with the orifice in the base portion elevated.

2. The toothbrush holder of claim 1 in which the base portion is curved when deployed.

3. The toothbrush holder of claim 1 in which the single piece of sheet material is polyethylene.

4. The toothbrush holder of claim 3 in which the polyethylene is high density polyethylene.

5. The toothbrush holder of claim 1 in which the thickness of the single piece of sheet material is between thirty and forty mils.

6. The toothbrush holder of claim 1 in which the key is a tab and the lock is a slot.

7. The toothbrush holder of claim 6 in which the slot is oriented at an angle to the first end edge of the holder portion.

8. The toothbrush holder of claim 1 in which the at least one toothbrush receiving orifice in the holder portion is sized to receive the shaft of any size manual toothbrush.

9. The toothbrush holder of claim 1 in which the at least one toothbrush receiving orifice in the holder portion has an area between 0.465 square inches and 1.240 square inches.

10. The toothbrush holder of claim 1 in which the at least one toothbrush receiving orifice in the holder portion has an area of approximately 0.465 square inches.

11. The toothbrush holder of claim 1 in which the holder portion includes two toothbrush receiving orifices each sized to receive the shaft of a toothbrush at the apex of the deployed curved holder portion.

12. The toothbrush holder of claim 11 in which the toothbrush receiving orifices are sized to receive the shaft of any size manual toothbrush.

13. The toothbrush holder of claim 11 in which the base portion includes two toothbrush receiving orifices each sized to receive the shaft of any size manual toothbrush each aligned with a toothbrush receiving orifice in the holder portion.

14. The toothbrush holder of claim 11 in which the apex of the deployed curved holder portion is spaced from the center of the base portion approximately 1.575 inches when the toothbrush holder is deployed.

15. The toothbrush holder of claim 1 in which the single piece of sheet material is paper.

16. The toothbrush holder of claim 15 in which the paper is wax-coated paper.

17. The toothbrush holder of claim 16 in which the wax-coated paper includes a sterile coating.

18. The toothbrush holder of claim 1 in which the single piece of sheet material is plastic.

19. The toothbrush holder of claim 1 in which the single piece of sheet material is PVC.

20. A deployable toothbrush holder comprising:

a single piece of sheet material made of polyethylene between thirty and forty mils thick having spaced first and second end edges;

a single fold area across the sheet material defining a holder portion and a base portion, the holder portion terminating in the first end edge, the base portion terminating in the second end edge;

two toothbrush receiving orifices in the holder portion, each toothbrush receiving orifice sized to receive the shaft of a toothbrush;

two toothbrush receiving orifices in the base portion, each toothbrush receiving orifice sized to receive the shaft of a toothbrush, and a key extending outwardly from the second edge; and a lock for receiving the key disposed in the holder portion spaced from the first edge to angle the base portion.

21. A deployable toothbrush holder comprising:

a single piece of sheet material having spaced first and second end edges;

a single fold area across the sheet material defining a holder portion and a base portion, the holder portion terminating in the first end edge and having a length relative to the base portion to impart a smooth sloping curvature to the holder portion without fold lines when the toothbrush holder is deployed, the base portion terminating in the second end edge;

at least one toothbrush receiving orifice in the holder portion sized to receive the shaft of a manual toothbrush;

at least one toothbrush receiving orifice in the base portion sized to receive the shaft of a toothbrush aligned with the orifice in the holder portion;

a tab extending outwardly from the second end edge; and a slot at an angle to the first end edge for receiving the key disposed in the holder portion, said slot spaced from the first end edge to angle the base portion and to deploy and support the holder portion in a position spaced from the base portion.

22. A toothbrush holder comprising:

a single piece of sheet material having spaced first and second end edges;

a single fold area across the sheet material defining a curved holder portion and a curved base portion, the holder portion terminating in the first end edge and the base portion terminating in the second end edge;

at least one toothbrush receiving orifice in the holder portion sized to receive the shaft of a toothbrush;

a key extending outwardly from the second edge; and a lock for receiving the key disposed in the holder portion spaced from the first end edge to angle the base portion.

23. A deployable toothbrush holder comprising:

a single piece of sheet material having spaced first and second end edges;

a single fold area across the sheet material defining a holder portion and a base portion, the holder portion terminating in the first end edge and having a length relative to the base portion to impart a smooth sloping curvature to the holder portion without fold lines when the toothbrush holder is deployed, the base portion terminating in the second end edge;

at least one toothbrush receiving orifice in the holder portion sized to receive the shaft of a toothbrush;

at least one toothbrush receiving orifice in the base portion sized to receive the shaft of a toothbrush and aligned with the orifice in the holder portion;

a key extending outwardly from the second edge; and a lock for receiving the key disposed in the holder portion, said lock spaced from the first end edge to angle the base portion and to deploy and support the holder portion in a position spaced from the base portion with the orifice in the base portion elevated, the base portion curved when deployed.

24. A deployable toothbrush holder comprising:

a single piece of sheet material having spaced first and second end edges;

a single fold area across the sheet material defining a holder portion and a base portion, the holder portion terminating in the first end edge and having a length relative to the base portion to impart a smooth sloping curvature to the holder portion without fold lines when the toothbrush holder is deployed, the base portion terminating in the second end edge;

at least one toothbrush receiving orifice in the holder portion sized to receive the shaft of a toothbrush;

at least one toothbrush receiving orifice in the base portion sized to receive the shaft of a toothbrush and aligned with the orifice in the holder portion;

a tab extending outwardly from the second edge; and a slot disposed in the holder portion oriented entirely at an angle to the first end edge of the holder portion for receiving the tab, said slot spaced from the first end edge to angle the base portion and to deploy and support the holder portion in a position spaced from the base portion.

* * * * *